United States Patent [19]

Crawford

[11] 4,194,319

[45] Mar. 25, 1980

[54] POTTED PLANT SUPPORT

[76] Inventor: Carroll O. Crawford, 14963-19th St., North, Loxahatchee, Fla. 33470

[21] Appl. No.: 897,914

[22] Filed: Apr. 19, 1978

[51] Int. Cl.[2] ..... A47G 7/00

[52] U.S. Cl. ..... 47/27; 47/39

[58] Field of Search ..... 47/1, 7, 2, 20, 21, 47/22, 26, 27, 28, 29, 30, 31, 32, 33, 39, 82, 83, 47

[56] References Cited

U.S. PATENT DOCUMENTS

| | | | |
|---|---|---|---|
| 419,484 | 1/1890 | Whyland | 47/39 |
| 499,240 | 6/1893 | Mann | 47/20 X |
| 1,072,339 | 9/1913 | Liljegran | 47/21 |
| 1,885,117 | 11/1932 | Lemert | 47/39 |
| 3,270,461 | 9/1966 | Fowler | 47/21 X |

FOREIGN PATENT DOCUMENTS

| | | | |
|---|---|---|---|
| 544647 | 2/1932 | Fed. Rep. of Germany | 47/21 |
| 11978 | of 1906 | United Kingdom | 47/39 |
| 968489 | 9/1964 | United Kingdom | 47/39 |
| 1232635 | 5/1971 | United Kingdom | 47/26 |

*Primary Examiner*—Edgar S. Burr

*Assistant Examiner*—James R. Feyrer

*Attorney, Agent, or Firm*—Malin & Haley

[57] ABSTRACT

A device for supporting a plurality of potted plants or the like, including a vertical support frame member having a hollow internal chamber, a plurality of radially extending frame members connected to the upper end of said vertical support and a plurality of lower radial frame members for engaging potted plants, an inlet means for receiving a source of water under pressure and a plurality of nozzle openings connected to the upper portion of the vertical support member. The device allows for the care of plants to include watering nozzles and a protective cover disposed over the upper frame members to properly shade the plants as required. The device may be connected to a city water supply with a hose or the like or have a permanent conduit installation which allows water flow into the center vertical member. Plants in pots are hung along the lower radial frame members. The protective cover is selected to provide a desired amount of sun or shade and may even be waterproof to prevent random amounts of rainfall to strike the plants. The cover also protects the plants from wind or other elements.

3 Claims, 6 Drawing Figures

POTTED PLANT SUPPORT

BACKGROUND OF THE INVENTION

This invention relates generally to a supporting frame and watering system for potted plants which are suspended by cords, hooks, or the like which provide an aesthetic display of potted plants and care of the plants by allowing adjustment of both sunlight and water, and specifically to a support system that includes a rigid vertical central member which has a central fluid chamber, a fluid inlet connector at one end and a plurality of fluid sprinkling nozzles disposed about the periphery of the vertical support member which are aligned to provide for sprinkling of the potted plants when they are suspended from the lower radial frame members.

Potted plant supports have been used in the prior art for arranging an array of various plants in pots. The plant supports and potted plant holders shown in the prior art do not provide for proper care of the plants but require that each individual potted plant be watered or possibly moved to provide adequate sunshine or shading when necessary. The present invention overcomes the problems of the prior art by providing for the support of a plurality of potted plants to provide an aesthetic array useful in a backyard area or the like that includes predisposed cover or covering panels which may be arranged for proper shading or sunlighting, protection of the potted plants, and a nozzle water spray system that insures proper watering of the supported plants.

BRIEF DESCRIPTION OF THE INVENTION

A device for supporting one or more potted plants comprising a rigid vertical support member, said rigid vertical support member having a fluid conduit disposed therein forming a hollow chamber along the longitudinal length of the support member. Coupled to the top of the support member are a plurality of radially disposed panel receiving frame members. Additional lower frame members are radially coupled, extending outwardly and are connected to the free ends of the upper frame support members forming a rib-like structure. The lower support frame members are horizontally disposed and are perpendicular substantially to the vertical support member and are sized to receive one or more connectors from a plurality of potted plants.

A fluid coupling inlet means is connected to the vertical support member and allows for the receipt of fluid such as water from a city water system. Disposed near the upper end of the vertical support member are one or more fluid nozzles which fluidly communicate with the interior hollow chamber of the vertical support member to allow for a fluid spray of fluid under pressure within the vertical support member. The spray nozzles are arranged in a predetermined pattern around the periphery of the upper portion of the vertical support member to provide for sufficient spray that will reach both the outer and the inner areas of the lower frame members (which are radially disposed).

The upper frame members are spaced angularly apart and are each disposed at an angle relative to the horizon downwardly from the apex of the vertical support member. The upper members are pivotally connected to the lower frame members and to the upper portion of the vertical support member while the lower frame members are pivotally connected to an annular sleeve disposed around the vertical support member. This allows for the device to be collapsed if necessary for a storage position or for transport.

One or more fabric or plastic panels may be affixed to the upper frame members to provide a protective cover for proper shading or sunlighting of particular plants as desired. The upper covering may be a complete unitary sheet of a particular material or it may be individually panelized between adjacent upper frame members. The construction of individual panels may vary to vary sunlight or shading under different panels.

It is an object of this invention to provide an improved potted plant support for displaying an array of potted plants while providing for the watering and proper sun shade protection of the plants.

It is another object of this invention to provide a collapsible potted plant supporting device which may be utilized to support a plurality of potted plants from a single supporting member, the device being collapsible when not in use.

And yet, still another object of this invention is to provide a plant support for potted plants, providing an improved aesthetic array of plants having a watering device and fixed or removeable panels coupled therein for controlling watering and sunshine of the plants.

In accordance with these and other objects which will be apparent hereinafter, the instant invention will now be described with particular reference to the accompanying drawings.

PREFERRED EMBODIMENT OF THE INVENTION

Figure 1:
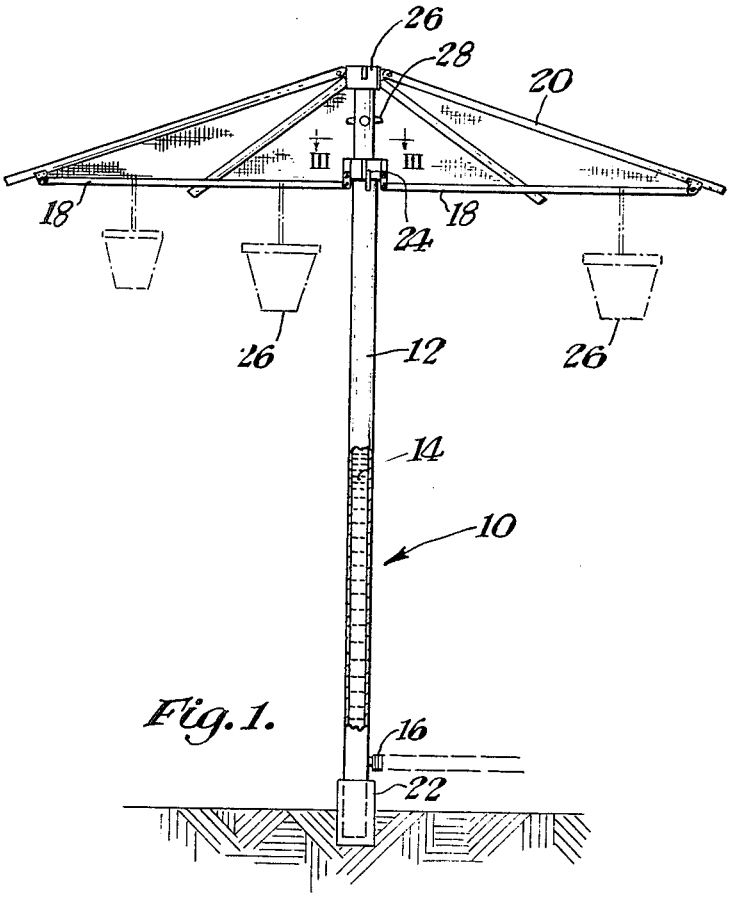
FIG. 1 shows a side elevational view partially in cross-section showing the instant invention in the open position.

Referring now to the drawings and specifically FIG. 1, the instant invention is shown generally at 10 comprised of a rigid hollow vertical support member 12 that may be anchored at one end by a concrete anchorage 22 or the like. The inside of the vertical support member is hollow to allow fluid to enter through a fluid outlet connector 16 coupled into the interior chamber 14 of the vertical support member.

A plurality of radially disposed rigid frame members 18 which are horizontal relative to the vertical support member 12 are connected to an annular sleeve 24 pivotally at one end near the radial center and at their exterior ends to a plurality of upper frame members 20 which are also radially disposed from the top connector 26 mounted on the vertical support 12.

The horizontal frame members 18 receive connectors from plant pots 26 (shown dotted) which are disposed radially along the longitudinal length of each of the frame members 18. Any number of particular lower frame members can be utilized to provide a particular number of horizontal supports for potted plants.

Upper and lower frame members, 20 and 18 respectively, are pivotally connected at their ends such that sleeve 24 in conjunction with the horizontal frame members may be moved to allow for the collapsing of the upper and lower frame members to a position substantially parallel to the rigid central support member 12.

Figure 2:
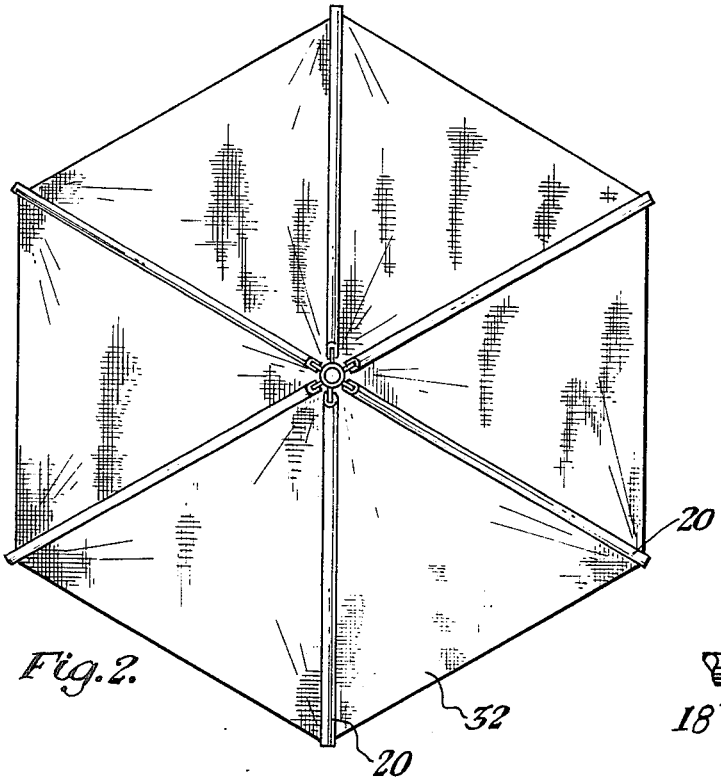
FIG. 2 shows a top plan view of the instant invention.

FIG. 2 shows a panel 32 that is a sunshade made of a fabric or the like which may be removeably disposed over the entire device or between adjacent frame members 20 at particular areas to provide shading of particular portions beneath. Thus, particular plants could be disposed that require more sun or shade as a function of the panels disposed on the top for sunshade. Additionally or alternatively, transparent plastic-like panels may be used for providing direct sunlight while still providing some shelter to the plants beneath both as to irregular rainfall which may be undesirable or wind elements or the like. The panels may be attached by conventional snaps (not shown) or the like.

Figure 6:
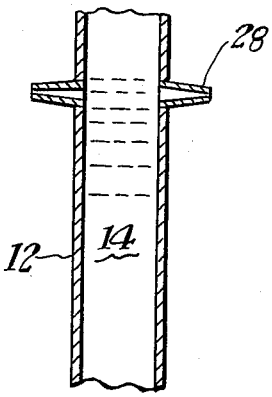
FIG. 6 shows a sprinkler nozzle in a side elevational, cross-sectional view as utilized in the instant invention.

FIG. 6 shows a nozzle 28 which is in fluid communication with the central cavity 14 of the vertical support member 12 which allows fluid to be sprayed from within the vertical member to plants, the fluid being radially sprayed from the central support member. The particular location of the nozzles may be varied in accordance with the spray pattern desired to insure that plants disposed along the horizontal support members may be adequately watered or fertilized with a liquid fertilizer.

Figure 4:
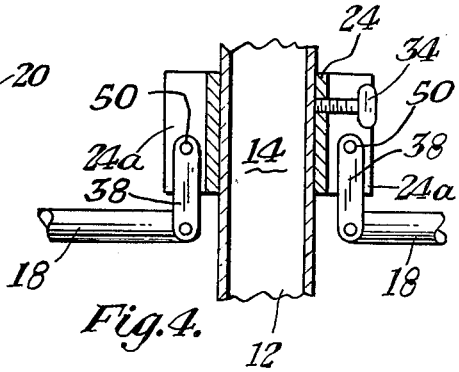
FIG. 4 shows a side elevational view partially in cross-section of the lower frame supporting sleeve as utilized in the instant invention.
Figure 5:
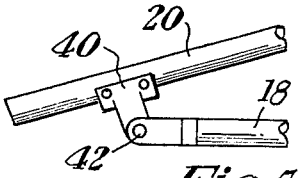
FIG. 5 shows the exterior coupling of the outer ends of the lower and upper frame members partially cut away in a side elevational view.

FIG. 4 shows the horizontal frame connector sleeve 24 which fits about the circumference of the vertical support member 12 and slides longitudinally along the vertical support. Each frame member 18 is pivotally connected by moveable arm 38 to a flange 24*a* by pins 50. A threaded locking pin 34 supports the sleeve 24, frictionally preventing it from sliding down the vertical support. FIG. 5 shows the exterior connection at the ends of the horizontal and upper frame members pivotally joined together by a flanged connector 40 having a pin 42 disposed therethrough and through frame member 18. Thus, the ends of frame members 18 and 20 pivot relative to each other allowing for collapsing of the upper portion of the frame. The horizontal frame members 18 in conjunction with the sleeve 24 and locking pin 34 thus in the open position of the device provide adequate support for one or more potted plants which are hung from the horizontal supporting frames.

Figure 3:
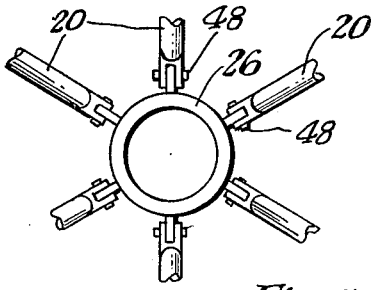
FIG. 3 shows a top plan view of the connection of the upper frame members to the central vertical support.

FIG. 3 shows the upper frame member ends connected to a flanged cap 26 mounted on top of vertical support 12 by pins 48 allowing pivotal movement of frame members 20.

In operation, the plants are supported on the horizontal members and arranged as desired (FIG. 1). A city water supply under pressure may be coupled by a garden hose or a permanent conduit into the vertical support member, the garden hose being connected through the male threaded connector 16.

The plants may be watered as desired by turning on the fluid source under pressure directing it into the central chamber of the vertical support member. Fertilizer could also be dispensed through the nozzles. The vertical support member may be anchored in the ground in a suitable receptacle or permanently.

Individual panels may be removeably connected between adjacent upper frame members 20 by appropriate snaps. Likewise a drop curtain could be added around the periphery for a complete enclosure to the ground.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for supporting one or more potted plants, comprising:

a rigid elongated vertical support member, said support member having a hollowed central chamber for receiving a fluid;

at least one sprinkler nozzle connected to the upper portion of said vertical support member and in fluid communication with the central portion of the vertical support member chamber;

a plurality of upper frame members connected to the upper end of said vertical support member at one end and disposed radially from the upper end of said vertical support member;

a panel connected to said upper frame members;

a sleeve disposed around said vertical support member;

a plurality of horizontally disposed, radially disposed rigid support members connected at their inside ends to said vertical support member sleeve and at the outside ends to said upper support members;

fluid inlet connecting means connected to said vertical support member; and means for supporting said vertical support member in a vertical position.

2. A device as in claim 1, including:

said sleeve disposed about the exterior periphery of said vertical support member, said sleeve connected pivotally to said lower horizontal frame support members; and a sleeve locking pin engageable with said vertical support member for receiving said sleeve to prevent movement longitudinally of said sleeve in one direction.

3. A device as in claim 1, including at least one plant holder connected to one of said horizontal support members.

* * * * *